United States Patent [19]

Stewart

[11] 4,077,247

[45] Mar. 7, 1978

[54] METHOD AND APPARATUS FOR IMPROVING THE FORMABILITY OF SHEET METAL

[75] Inventor: Dennis C. Stewart, West Palm Beach, Fla.

[73] Assignee: United Technologies Corporation, Hartford, Conn.

[21] Appl. No.: 618,085

[22] Filed: Sep. 30, 1975

[51] Int. Cl.[2] ..... B21D 28/26

[52] U.S. Cl. ..... 72/325; 72/379; 72/385; 29/163.5 R

[58] Field of Search ..... 72/385, 380, 386, 389, 72/379, 327, 333, 335, 325; 113/116 Y; 428/178, 179, 180; 29/163.5 R

[56] References Cited

U.S. PATENT DOCUMENTS

| | | | |
|---|---|---|---|
| 1,481,000 | 1/1924 | Erickson | 29/163.5 R |
| 2,157,354 | 5/1939 | Sherman | 72/379 |
| 2,859,510 | 11/1958 | Baxa | 72/325 X |
| 3,083,662 | 4/1963 | Zeidler | 72/379 X |
| 3,525,663 | 8/1970 | Hale | 428/179 |
| 3,902,348 | 9/1975 | Hale | 72/342 |
| 3,938,963 | 2/1976 | Hale | 29/191.4 |

*Primary Examiner*—Lowell A. Larson
*Attorney, Agent, or Firm*—Jack N. McCarthy

[57] ABSTRACT

A method of improving the formability of sheet metal wherein the sheet metal is formed by die pins contacting spaced parts of the sheet with the properties of the sheet material itself determining the actual condition of curvature between the spaced parts contacted by the die pins. The sheet metal is perforated at the spaced part of the sheet contacting each die pin so that as each die pin is pressed into the sheet, each perforation expands and additional sheet material is supplied to the shoulder of the pin. Tops of the die pins can be modified with a boss to locate the perforations in the sheet metal and position it in respect to the die pins. Modified die pin tops can be formed with pointed inserts so that solid sheet metal can be used with the inserts piercing the sheet and the die pins then forming it. The sheet metal can also be partially formed and then perforated before the final forming.

2 Claims, 10 Drawing Figures

METHOD AND APPARATUS FOR IMPROVING THE FORMABILITY OF SHEET METAL

The invention herein described was made in the course of or under a contract or subcontract with the Department of the Air Force.

BACKGROUND OF THE INVENTION

This invention relates to a method and apparatus for improving the formability of sheet metal and particularly for its use as a structural member. The prior art is clearly shown by the patent to Robb, U.S. Pat. No. 3,227,598 wherein a process using die pins is disclosed which enables formation of a high-strength, three-dimensional article from a single flat sheet of ductile material. Other patents also disclosing the use of die pins to deform sheet material are U.S. Pat. No. 3,525,663 and U.S. Pat. No. 3,902,348.

It has been found that a limiting factor experienced during the forming of unperforated sheet metal by the dies shown in the above-identified patents is the material thinning which occurred in the sheet metal in the region of the edge of the free end of the die pins. As the projections of a given sheet metal are increased in heighth greater stress is placed at this region. This thinning increases the likelihood of premature rupturing of the sheet. It is noted that U.S. Pat. No. 3,902,348 sets forth another method to attempt to overcome this shortcoming of the prior art method.

SUMMARY OF THE INVENTION

It is an object of this invention to provide a method for forming sheet metal with projections by the use of die pins contacting spaced parts of the sheet with the properties of the material itself determining the actual condition of curvature whereby perforations are placed in the sheet metal to be engaged by the free ends of the die pins so that during the forming operation the perforations expand in size providing additional flow of the metal being formed, thereby decreasing material thinning in the region of the shoulders formed around the free ends of the die pins.

It is another object of this invention to leave a sufficient surface on the top of the projections around the expanded perforations as for bonding.

An object of this invention is to provide a method for improving the formability of sheet metal being formed by die pins by supplying additional material to critical areas where the metal thins, thereby permitting increased projection heighth and lower article density for a given sheet material.

It is another object of this invention to provide bosses for extending through the perforations in a metal sheet to be formed to properly position the perforations in the sheet with all of the die pins.

It is an object of this invention to provide a sharpened insert on the die pins which will pierce a sheet forming the perforations when suitable forming pressure is brought to bear. A simple sharpened insert can be used to merely form a perforation of predetermined size or a tapered insert can be used which will mechanically aid in expanding the perforation as it pierces the sheet.

It is another object of this invention to introduce perforations in a sheet after the forming of the sheet is partially complete.

DESCRIPTION OF THE PREFERRED EMBODIMENT

Figure 1:
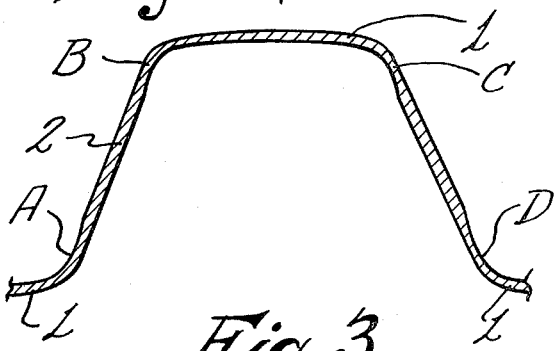
Fig. 1 (PRIOR ART)
FIG. 1 is a sectional view through an unperforated core node of the prior art showing material thinning in the region of the node shoulder.
Figure 2:
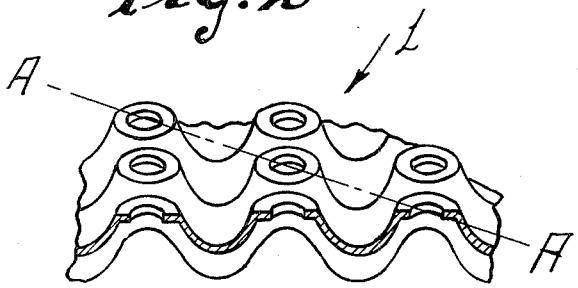
FIG. 2 is a fragmentary perspective view of a sheet metal article formed by the method of my invention.

Referring to FIG. 1, a cross section through projections 1 in formed sheet metal 2 is shown, wherein the sheet metal is shown thin at A, B, C and D. The thin areas B and C are formed at the shoulders of a die pin extending upwardly from a die member during the forming operation and the thin areas A and D are formed at the shoulders of die pins extending downwardly from a second die member on opposite sides of the other die pin. This drawing is a representation of an actual formed sheet which was cut through on an axis of the formed sheet which extends through adjacent up and down projections (see A—A of FIG. 2). To eliminate or reduce objectionable thinning a method was devised where perforations are placed in the sheet metal 2 to be located over the center of the upwardly projecting die pins 4 and the downwardly projecting die pins 6. This arrangement is shown in FIG. 3.

Various arrangements of the pins can be made such as disclosed in the prior art set forth above. One location of pins is an arrangement such that any four pins on one die form a square while pins on the other mating die extend into the center of each of the square arrangement of pins. The patent to Robb shows the pins arranged in groups as squares, as triangles, and as polygons while Hale (U.S. Pat. No. 3,525,663) discusses a square and a triangular pattern. The precise number of pins and arrangements does not form part of this invention.

Figure 3:
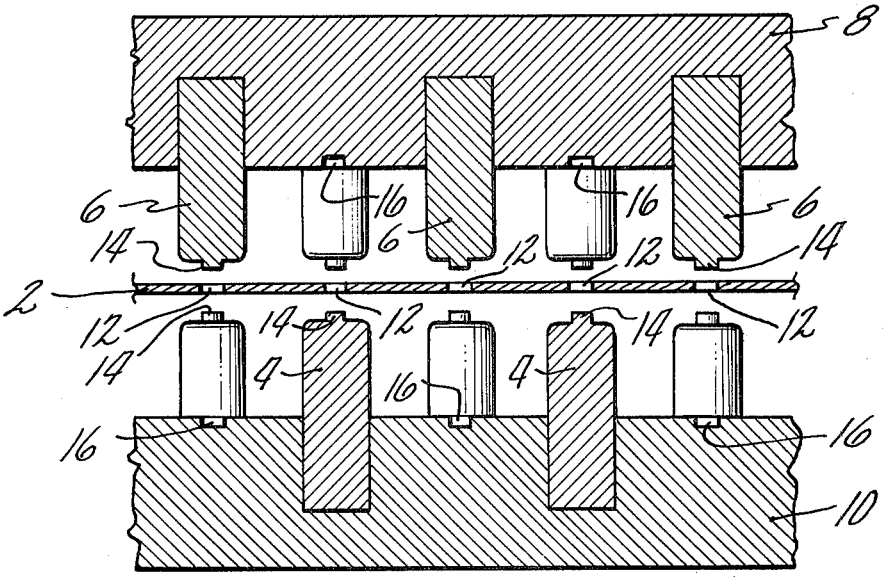
FIG. 3 is an elevational view in cross section of the apparatus for forming the article of FIG. 2 with sheet material positioned therein prior to forming.

As shown in FIG. 3, an upper die member 8 and a lower die member 10 are shown in an open position with sheet metal 2 located between the die pins 6 and 4 extending from the die members. These pins 6 and 4 are arranged in the mating square pin arrangement generally used. The sheet metal 2 has been formed with openings 12 aligned with each of the die pins 6 and 4 of the die members 8 and 10, respectively. Means are provided to properly position the sheet metal plate 2 so that the openings 12 are placed in line with the center of each of the end faces of the die pins 6 and 4. In FIG. 3 this is done by providing bosses 14 extending from the center of the free face of a plurality of the die pins 4 and a plurality of the die pins 6. The bosses 14 are formed slightly smaller than the openings 12 in the sheet metal plate 2. It can be seen that these bosses 14 properly locate the perforations of the sheet metal 2 and hold it in place when they are positioned on the bosses 14 of the die pins 4 of the lower die. Other locating means can be used if desired.

Figure 4:
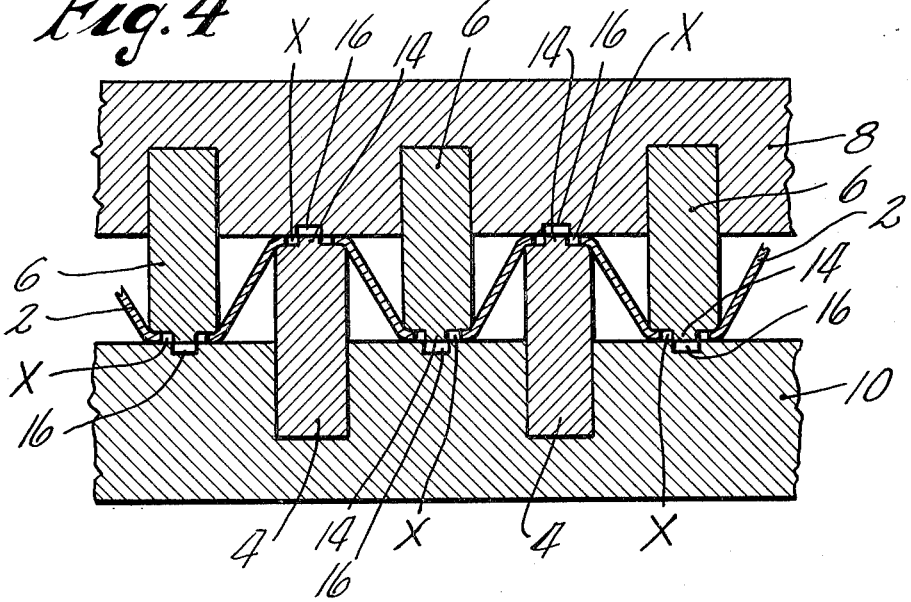
FIG. 4 is an elevational view in cross section showing the apparatus of FIG. 3 after the sheet material has been formed into the article of FIG. 2.

As the die members 8 and 10 are moved together so that the upper and lower die pins 6 and 4, respectively, engage the sheet metal 2, the die members are pressed together until the desired depth of the projections are formed. This may include pressing until the die pins 6 and 4 press the sheet metal 2 against the die members 10 and 8, such as shown in FIG. 4, or stopped by other means to obtain the desired predetermined depth. It is noted that the press means to actuate the die members 8 and 10 can be any type press means desired which can produce the force necessary to press the die pins 6 and 4 into the metal sheet 2. Recesses 16 are formed in the face of die members 8 and 10 to receive the bosses 14 of the die pins from the opposite die member that projects through the openings 12, if necessary.

It can be seen that during the forming operation of the sheet metal 2 each perforation 12 is expanded and its edge pulled away from the center of its cooperating die pin as shown in FIG. 4 at X. As a result of this movement of material of the sheet metal, the tendency to thin or reduce at the shoulder of the face of the die pin is reduced leading to the formation of formed sheets having increased projection heighth and lower article density for a given sheet material. The perforations are expanded to a size which will leave a sufficient surface area on the tops of the projections to affix another member such as by bonding.

Figure 5:
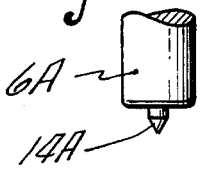
FIG. 5 is a view of the free end of a die pin having a sharpened insert in the center thereof.
Figure 6:
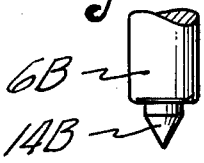
FIG. 6 is a view of the free end of a die pin having a modified sharpened tapered insert.
Figure 7:
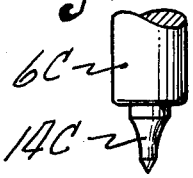
FIG. 7 is a view of the free end of a die pin having another modified sharpened tapered insert.

While the method just disclosed uses pre-perforated sheet metal, the sheet metal may be perforated just before the forming method by placing a pointed or otherwise sharpened insert 14A in the center of each face of each die pin which will pierce the sheet metal when suitable pressure is brought to bear (see representative die pin 6A in FIG. 5). For sheet metal materials which are easily formed by the die pins, a simple insert is used. For sheet metal material of less ductility, inserts 14B and 14C can be used which will both pierce the material and mechanically expand a perforation by the sides of the tapered insert (see representative die pins 6B and 6C in FIG. 6 and FIG. 7). The degree of taper of the insert 14B and 14C is determined by experimenting with the material to be used. Insert 14C is formed as a combination of the inserts 14A and 14B. Recesses similar to the recesses 16 in FIGS. 3 and 4 must be placed in the die member opposite these perforating inserts 14 to allow them to seat if the formation of the sheet metal brings them in close proximity.

Further, the perforations may be introduced after the sheet metal has been partially formed by the use of perforating inserts 20 placed in the die members 8 and 10 directly opposite the centers of the opposing faces of the die pins 4D and 6D, respectively. A recess 22 is placed in the center of each face of the die pins 6D and 4D to allow the perforating inserts to completely pierce the sheet metal and permit the completion of the forming of the sheet metal. Using this method, forming and piercing is also accomplished in one pressing operation.

Figure 8:
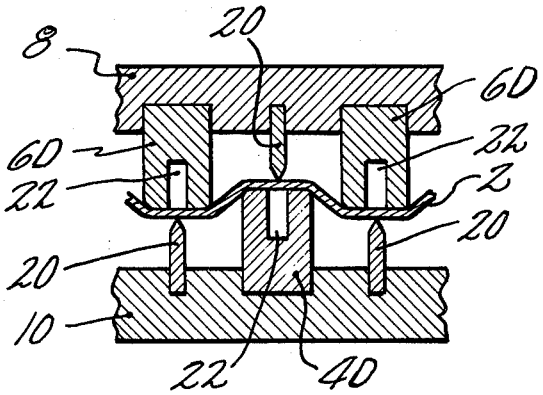
FIG. 8 is an elevational view in cross section of a modified apparatus for forming the core of FIG. 2.
Figure 9:
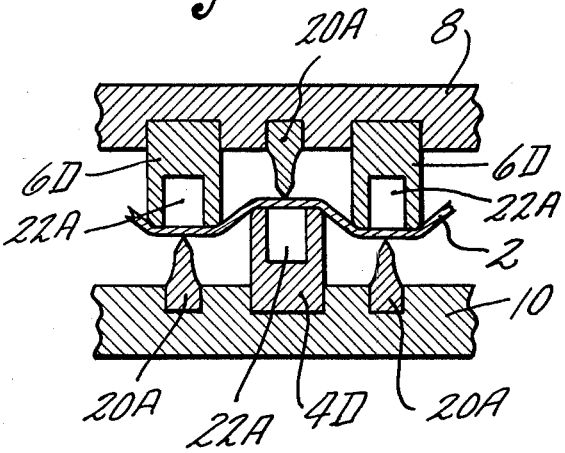
FIG. 9 is an elevational view in cross section of another modified apparatus for forming the core of FIG. 2.

The perforating insert may be of a uniform diameter as shown in FIG. 8 or a tapered section can be used as shown in FIG. 9. As before, the tapered insert provides for forced expansion thereby facilitating the flow of metal of the sheet material over its cooperating die pin and into the region of the shoulder.

Figure 10:
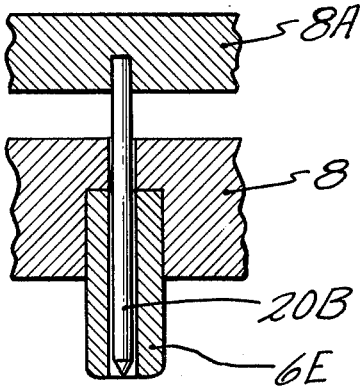
FIG. 10 is an elevational view in cross-section of an apparatus for forming perforations after the sheet has been partially formed.

FIG. 10 shows another arrangement which can be used for introducing perforations after the sheet metal has been partially formed by the die pins. This arrangement calls for an opening extending through the die pins 6E and the die member 8 with an insert 20B extending into the opening and being mounted in a second die member 8A spaced rearwardly from die member 8. Separate press means are used to actuate the die members 8 and 8A. After the desired partial forming has been achieved by the die pins 6E, the inserts 20B are caused to move within the die pin 6E by movement of the die member 8A and pierce the faces of the sheet metal being formed.

The inserts 20B can be formed having other shapes such as 20A, whereby the die members 8 and 8A can be moved at different rates so that as the die pins 6E are forming the projections, the tapered die pins 20B, just referred to, can be moved into the perforations formed by the tip thereof since the tapered perforating insert is pushing in the same direction as the die pin. Only the upper die pins are shown in FIGS. 5, 6, 7 and 10 to hold the number of figures to a minimum.

It is noted that while sheet metal has been used in the description above, the described method and apparatus can be used with any sheet material capable of being plastically deformed, such as described in the patents listed above.

I claim:

1. A method for forming a projection having an annular shoulder at its end extending inwardly into an annular end surface with a center perforation therein in sheet material capable of being deformed with a die pin while reducing material thinning in said sheet material adjacent said annular shoulder by the contacting end of the die pin comprising the steps of:

(a) forming a perforation in said sheet material,
(b) forming a die pin having an end surface larger than the perforation,
(c) placing the end of said die pin over the perforation so that the end of the die pin covers and extends arond the perforation,
(d) moving said die pin relative to said sheet material to form a projection in said sheet material having an annular shoulder and an end surface while expanding said perforation in said end surface increasing the flow of material over the edge of the end of the die pin at the annular shoulder to decrease material thinning at that location while leaving an annular end surface extending inwardly from said annular shoulder.

2. A method for forming a projection having an annular shoulder at its end extending inwardly into an annular end surface with a center perforation therein in sheet material capable of being deformed with a die pin while reducing material thinning in said sheet material adjacent said annular shoulder by the contacting end of the die pin comprising the steps of:

(a) forming a die pin,
(b) placing the end of said die pin against said sheet material,
(c) moving said die pin relative to said sheet material to partially form a projection in said sheet material having an annular shoulder at its end extending inwardly into a full end surface, (d) forming a perforation in said sheet material at the end in the full end surface of said partially formed projection which is smaller than the end of said die pin, (e) moving said die pin relative to said sheet material to completely form the projection in said sheet material having an annular shoulder and an end surface while expanding said perforation in said end surface increasing the flow of material over the edge of the end of the die pin at the annular shoulder to decrease material thinning at that location while leaving an annular end surface extending inwardly from said annular shoulder.

* * * * *